United States Patent [19]

Diener

[11] 4,026,511

[45] May 31, 1977

[54] DESTRUCTIBLE BORE FORMING MEANS

[76] Inventor: Erhard Armin Diener, 643 Saskatchewan Crescent E., Saskatoon, Saskatchewan, Canada

[22] Filed: Nov. 14, 1975

[21] Appl. No.: 631,880

Related U.S. Application Data

[63] Continuation-in-part of Ser. No. 440,589, Feb. 7, 1974, Pat. No. 3,921,953.

[52] U.S. Cl. ..... 249/62; 249/177; 249/184

[51] Int. Cl.[2] ..... B28B 7/34

[58] Field of Search ..... 249/61–63, 249/177–178, 180, 183–184; 425/DIG. 12; 264/317, DIG. 44

[56] References Cited

UNITED STATES PATENTS

| | | | |
|---|---|---|---|
| 1,482,565 | 2/1924 | Johnson et al. | 249/177 |
| 2,589,177 | 3/1952 | Wilhelm | 425/DIG. 12 |
| 2,684,518 | 7/1954 | Whitlock | 249/177 |
| 3,265,349 | 8/1966 | Hamrick | 249/177 |
| 3,632,724 | 1/1972 | Hilgeman, Jr. | 249/62 |

*Primary Examiner*—Francis S. Husar
*Assistant Examiner*—John McQuade
*Attorney, Agent, or Firm*—Stanley G. Ade

[57] ABSTRACT

This is a device for forming vents or bores in concrete floors. A cylindrical base portion is secured to the surface upon which the concrete is to be poured and a rigid foam cylindrical portion is pushed downwardly into the base whereupon an upper cylindrical guard portion may be pushed over the upper end of the cylindrical core. Both the base and the guard portion are provided with inwardly projecting lugs which hold the cylindrical core into the base and hold the guard portion of the upper end of the cylindrical core. An ignitor cord harness extends around the cylindrical core which, when ignited, melts this core. The concrete floor is poured with the guard portion projecting above the floor level and after the concrete has set, the ignitor harness can be ignited thus melting and charring the core thus leaving a smooth cylindrical bore through the concrete floor.

8 Claims, 16 Drawing Figures

DESTRUCTIBLE BORE FORMING MEANS

This invention is a continuation-in-part application of Ser. No. 440,589 dated Feb. 7, 1974, now U.S. Pat. No. 3,921,953 and relates to new and useful improvements in the formation of holes or vents in concrete floors or walls.

BACKGROUND OF THE INVENTION

Normally, a metal sleeve or the like is installed prior to the pouring of concrete which is then removed when the concrete has set. Alternatively, the concrete has to be drilled in order to form the hole through which various pipes, conduits and the like are required to pass. Such conduits may include dryer vents, bathroom vents, air intakes, venting openings, water, gas and electrical conduits and the like.

The present methods suffer from several disadvantages. Obviously when concrete has to be drilled after it has set, considerable time and effort is required. Furthermore, it is difficult to form an aperture through a concrete wall which is of the correct dimension and which is provided with relatively smooth sides. This means that the wall has to be patched and filled after the conduit or the like has been extended through the concrete wall or floor.

The metal sleeves also suffers from several disadvantages inasmuch as it is usally relatively thin walled which wall is easily distorted during the pouring of the concrete. Futhermore, when the walls and/or floor are poured, it is not always known exactly where such vents are required and furthermore, if they are not required immediately, they have to be temporarily filled or sealed in order to preserve the integrity of the wall of floor.

SUMMARY OF THE INVENTION

The present invention overcomes these disadvantages by providing a core form device which, in the case of walls, may be placed between the forms prior to the pouring of concrete and which, in the case of floors, may be placed in the desired location prior to the pouring of the concrete floor.

Once the concrete has been set and forms are removed, the device may be fired immediately or may be left until it is desired to form a hole or vent through the concrete wall. If the vent is not required at the present time, the device completely seals the wall and may be left until it is desired to utilize such a hole or bore within the wall or floor.

The device includes a semi-rigid core of a cellular thermoplastic material together with an ignition cord or the like embedded therein which, when fired, either melts or partially burns the core so that the aperture or bore is easily cleared out and ready to receive the conduit or sleeve which will pass through the wall.

The principal object and essence of the invention is therefore to provide a device of the character herewithin described which can be inserted within the wall forms or placed upon the floor supporting surface whereupon concrete or the like can be poured therearound to embed the device therein. In the wall embodiment, the ends of the device are then flush with the outer surfaces of the concrete once the forms are removed and with the floor device, the upper surface is just below the surface of the concrete floor and this particular device includes an upstanding indicator device so that it can readily be located when desired.

Another object of the invention is to provide a device of the character herewithin described which, when used between concrete forms, is compressible in length within limits to facilitate the engagement thereof between the forms. Furthermore, the ends include friction grip means which will engage the wood forms and locate the device in the desired position and maintain same in this position during the pouring of the concrete or the like therein between the forms.

Another object of the invention is to provide a device of the character herewithin described, one embodiment of which permits the pipe to be inserted through the device and to be sealed therein once it has been so inserted.

Summarizing, a device provided which enable holes or bores of any diameter within reason, to be formed in concrete walls for floors after the pouring thereof and after the walls have hardened and the forms have been removed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 10:
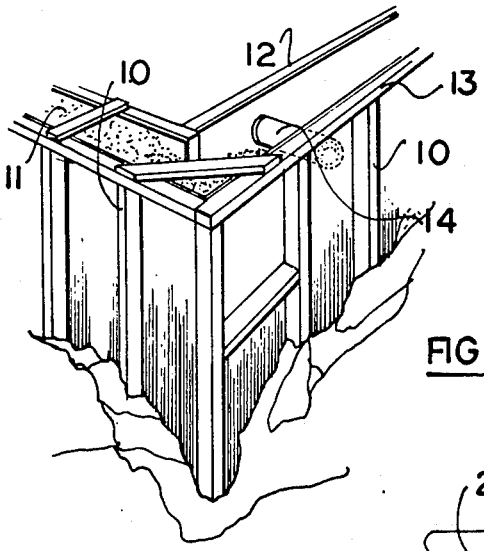
FIG. 10 is a fragmentary isometric view of a concrete wall form showing one of the devices inserted therebetween.
Figure 12:
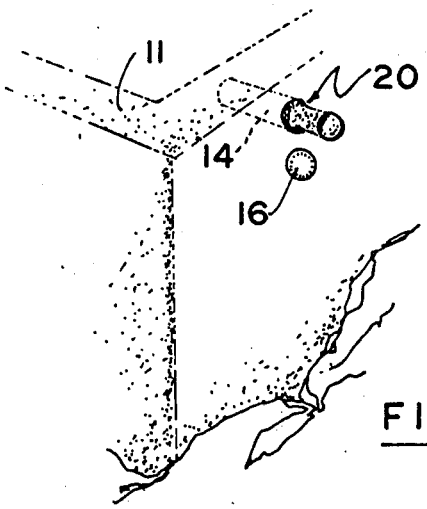
FIG. 12 is a fragmentary isometric view of a formed concrete wall with the device in use therein.
Figure 13:
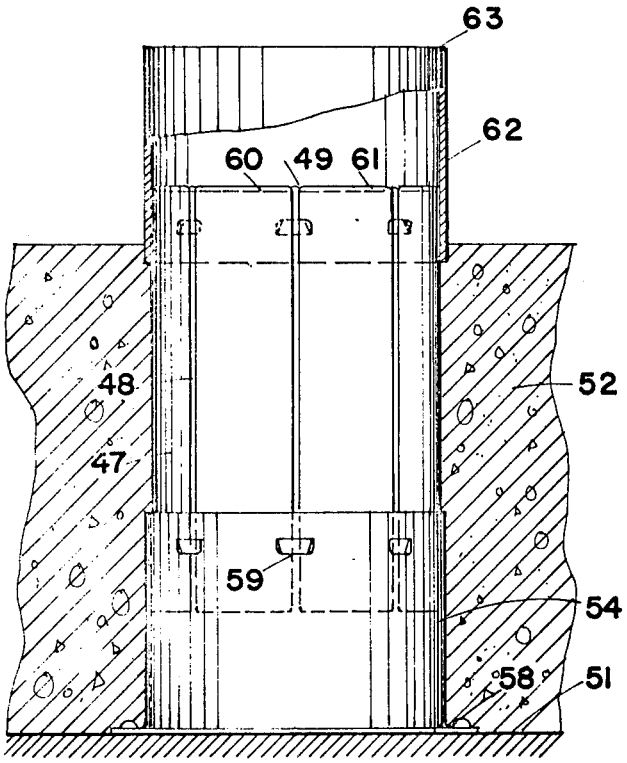
FIG. 13 is a partially sectioned side elevation of the preferred embodiment of the device shown installed in a cross sectional view of a concrete floor.
Figure 15:
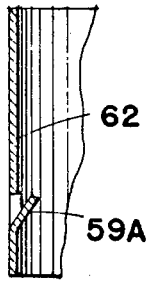
FIG. 15 is an enlarged fragmentary cross sectional view of one side of the upper shroud of FIG. 13.
Figure 16:
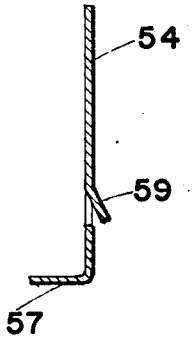
FIG. 16 is an enlarged fragmentary cross sectional view of part of the supporting base of FIG. 13.
Figure 14:
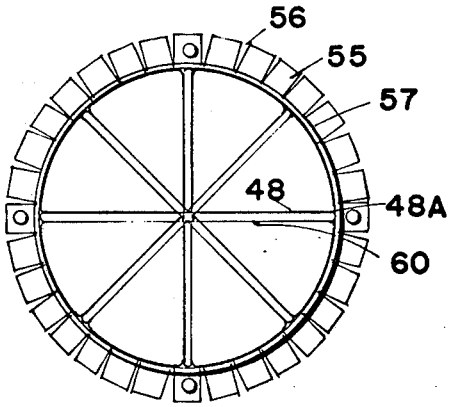
FIG. 14 is a top plan view of FIG. 13.

Proceeding therefore to describe the invention in detail, reference should first be made to FIG. 10 which illustrates a portion of a concrete form structure 10 for forming concrete walls 11 and it will be noted that the form structure 10 includes an inner form 12 and an outer form 13 maintained in spaced and parallel relationship one with the other. Concrete or the like is poured between these forms and when the concrete hardens, the forms are stripped off thus leaving the concrete walls 11 as clearly shown in FIG. 12.

Figure 1:
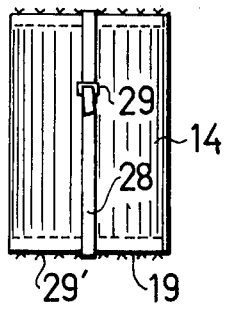
FIG. 1 is a side elevation of one embodiment of the device in the fulling compressed condition.
Figure 2:
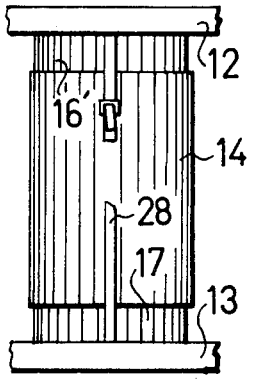
FIG. 2 is a view similar to FIG. 1, but showing same between two forms and in the expanded position.
Figure 3:
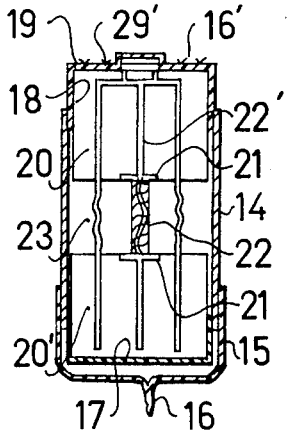
FIG. 3 is a longitudinal cross-sectional view of FIG. 2.

When it is desired to provide apertures or vent means through these walls, the device of the present invention is utilized and dealing first with the embodiment illustrated in FIGS. 1, 2 and 3, the device includes a cylindrical sleeve 14 made of plastic, cardboard or the like and being surrounded by a flexible plastic wrap 15 which is twisted at the ends 16 to enclose the device and to prevent moisture from entering therein.

Sliding end caps 16′ and 17 are provided, said end caps including an annular flange portion 18 and a circular end disc portion 19. The annular flange portions are slidably engaged within the ends of the cylindrical sleeve 14.

Situated within the sleeve 14 and in a slidable relationship therewithin, is a pair of core portions 20 and 20′. Each of these portions is cylindrical having a diameter similar to the diameter of the inside of the sleeve 14. They are formed preferably from a semi-rigid material such as a thermoplastic such as styrofoam or the like, said plastic having the capability of melting under heat and partially burning.

Any form of plastic which satisfies these physical conditions can be used and each portion 20 is provided with a reinforcing disc 21 situated concentrically within the inner ends of the portions.

A compression spring 22 extends between the reinforcing discs 21 and normally biasses the portions away from one another and against the end caps 16′ and 17.

Means to ignite the plastic are provided and in this embodiment take the form of ignitor cords 22′ which are embedded throughout the plastic cores 20 and 20′ and extend substantially from one end to the other. It will be noted that these ignitor cords also span the area 23 between the inner surfaces of the two portions 20 and 20′.

These cords are commercially available and have the capacity of burning without oxygen, the necessary oxygen being provided within the composition of the cords.

Figure 4:
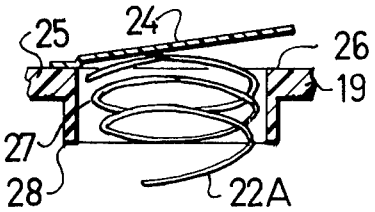
FIG. 4 is an enlarged fragmentary cross sectional view of the upper cover portion of FIG. 3.

Situated concentrically on the end cap 16′ is a detachable cover portion 24 and one embodiment of such cover portion is shown in FIG. 4. A plastic disc is sealed at one side thereof as indicated at 25 and is snap engaged upon a projection 26 extending upwardly from the circulator disc 19.

This circular disc is apertured underneath the cover portion 24, said apertured being indicated by reference character 27 and a relatively small cylindrical sleeve 28 is formed around this apertured internally of a cover portion 16′. Means to ignite the cord 22′ are provided and, in this embodiment, take the form of an extending portion 22A of the ignitor cord which is coiled loosely within the space below the cover 24 so that disengagement of the cover permits access to this portion which can be used to ignite the ignitor cord.

Means are provided to maintain the portions 20 and 20′ together with the end caps 16′ and 17 in the fully compressed position shown in FIG. 1 until ready for use.

A flexible strap assembly 28 extends around the sleeve and over both end caps 16′ and 17. The device is compressed manually and the strap is tightened by the buckle assembly 29.

In use, the device is positioned between the forms 12 and 13 manually, whereupon the strap assembly is severed or cut. This permits spring 22 to move the two core portions 20 and 20′ away from one another and to urge the end caps 16′ and 17 outwardly relative to the sleeve 14 so that they engage the inner surfaces of the forms 12 and 13 as clearly shown in FIG. 2. Small pointed projections 29′ may be formed on the outer surface of the end caps 16′ and 17 to assist in frictionally maintaining the device in the desired position between the forms 12 and 13 and to reinforce the frictional engagement caused by spring 22.

The concrete or the like is poured between the forms and allowed to set whereupon the forms are peeled away and the device is embedded within the concrete with the circular discs 19 of the end caps being flush with the outer surfaces of the concrete walls 11.

When it is desired to form the vent through the concrete wall, the flexible plastic wrap 15 covering the end cap or cover 24 is broken and the cover 24 is removed thus exposing the portion of the ignitor cord 22A. This is ignited and after burning has taken place, the cores are partially melted and charred so that they can easily be knocked out of the concrete wall as clearly shown in FIG. 12, it being understood that the end caps 16′ and 17 are removed prior to knocking out the core. This leaves a completely smooth bore of the desired dimension adapted to receive the necessary conduit or vent pipe as desired.

Figure 5:
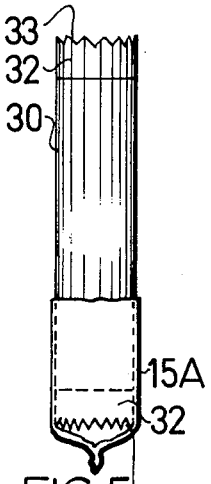
FIG. 5 is a side elevation of an alternative embodiment of the device.
Figure 6:
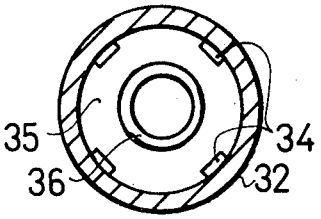
FIG. 6 is a top plan view of FIG. 5.
Figure 7:
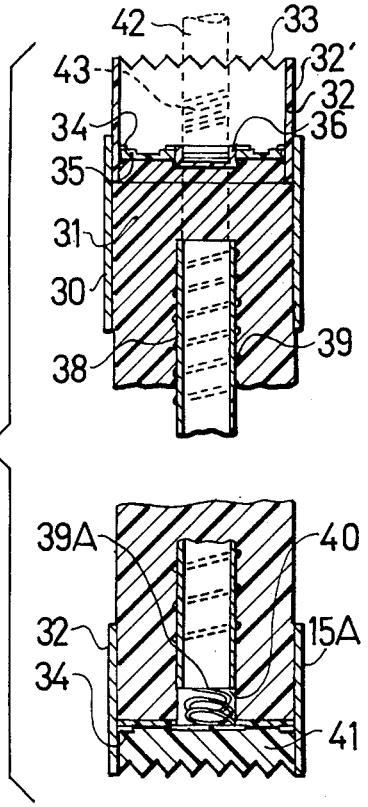
FIG. 7 is a fragmentary longitudinal sectional view of FIG. 5.

When it is desired to utilize the device for the insertion of relatively small diameter pipes such as gas, water and electricity conduits, the embodiment shown in FIGS. 5, 6 and 7 is preferred.

This embodiment includes a cylindrical sleeve 30 formed of similar material to sleeve 14 and being filled with a semi-rigid plastic material such as plastic or foam rubber indicated by reference character 31. In this embodiment, synthetic plastic material is shown.

End sleeves 32 are provided and take the form of relatively small cylindrical portions which are slidably engageable within the ends of the sleeve 30 and the outer edges of these sleeves are serrated as indicated by reference character 33 to act as friction engaging means within forms 12 and 13 similar to the projections 29′ hereinbefore described.

The end sleeve specifically designated 32′ in FIG. 6, situated at the upper end of sleeve 30 with reference to the drawings, is provided with inwardly extending projections 34 intermediate the ends thereof against which a plastic disc 35 engages from the inner end of the end sleeve 32 and the end of the foam 31 engages this disc and restrained thereby as clearly shown.

This disc is centrally apertured and a small cup-like portion 36 is frictionally engaged within this aperture with the open side of the cup facing outwardly.

The other end sleeve portion 32 is also provided with inwardly extending projections 34 and the other end of the foam engages with the projections and is restricted against outward movement by these projections This means that the two end portions or sleeves 32 can be compressed inwardly relative to the sleeve 30 thus compressing the foam 31 and when this pressure is released, the compressed foam will expand longitudinally thus moving the two end sleeve portions outwardly away from one another and this compressibility of the effective length of the device is used to engage this embodiment between the forms 12 and 13 with the compression of the foam 31 providing the necessary force to engage the serrated edges 33 against the inside of the foam.

Figure 11:
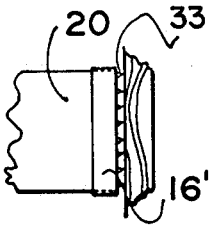
FIG. 11 is an enlarged fragmentary side elevation showing one method of friction gripping of the device against the form.

The position of the serrations relative to the forms is shown clearly in FIG. 11.

The cylindrical form 38 is embedded coaxially within the foam 31 and terminates spaced from the ends thereof as illustrated in FIG. 7 and this form is preferably hollow and manufactured from a material which is burnable.

Ignitor means taking the form of an ignitor cord 39 is spirally wound around this form and extends from one end to the other with one end extending into a relatively small cylindrical bore 40 formed in the one end of the foam as an extension to the form 38 and this extended portion 39A acts as ignitor means for the ignitor cord 39. At this end of the device, a detachable foamed plastic plug 41 engages within the portion of the end sleeve beyond the projections 34 and not only protects the ignitor cord portion 39A against the ingress of moisture or the like, but acts as a smooth outer surface to the concrete walls 11 until it is desired to form the aperture or bore through the concrete walls.

The other or upper end sleeve 32' may also be provided with a detachable foam plug similar to plug 41.

In operation of this device, the end sleeve portions 32' are manually compressed one towards the other thus compression the foam 31 and allowing the device to be slipped between the forms 12 and 13 and to be positioned where desired. A release of this pressure enables the foam 31 to expand the end sleeves outwardly away from one another so that the serrations 33 engage the inner surfaces of the concrete wall forms 12 and 13.

After the wall has been formed and the forms have been removed, the outer surfaces of the foam plugs 41 or the equivalent are flush with the surfaces of the wall. When it is desired to form the bore through the wall, these end plugs 41 are removed and the ignitor cord portion 39A is pulled from the recess 40 and ignited. The cord is similar to that hereinbefore described and burns through the length together with the form 38.

This softens and melts the foam 31 whereupon a conduit such as a water pipe or the like indicated in phantom by reference character 42, can be pushed through. In this regard, the end of the pipe 42 is engaged within the cup 36 which protects the end particularly if the end is threaded as indicated by reference character 43. The pipe is pushed longitudinally through the foam which is partially melted until it extends clear through the wall and is located in the desired relationship with the wall. As the partially melted foam hardens, it seals around the pipe or conduit thus sealing it in position within the wall 11 yet still allowing slight resiliency which facilitates the attachment of further conduits upon the ends of said pipe or conduit 42. This gives a completely sealed bore through the wall and enables conduits of various sizes within limits, to be engaged therethrough.

Reference should next be made to FIGS. 8, 9 and 13 to 16 which show an embodiment of the device specifically designed for use in concrete floors wherein it may be desirable to form a bore or opening through the floor to connect, for example, with a sewer outlet 44.

Figure 8:
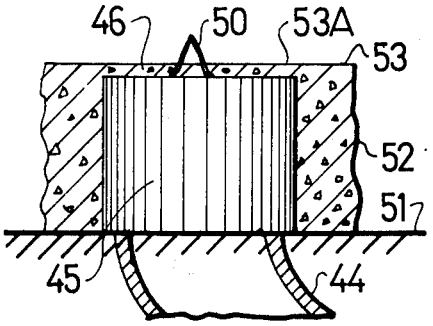
FIG. 8 is a partial cross sectional view of a concrete floor showing a further embodiment of the device situated therein.
Figure 9:
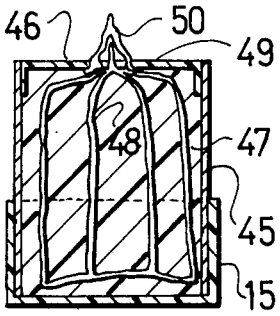
FIG. 9 is a cross sectional view of the device shown in FIG. 8.

The embodiment shown in FIGS. 8 and 9 includes a cylindrical sleeve 45 similar to sleeves 14 and 30 having an upper end cap 46 engageable therein. The entire device may be wrapped in flexible plastic similar to plastic 15.

A cylindrical core 47 is inserted within the sleeve 45 and is manufactured from a semi-rigid cellular thermoplastic material such as styrofoam and ignitor cords 48 are embedded within this core as illustrated in FIG. 9.

These ignitor cords terminate in a common ignitor portion 49 extending through an aperture within the cover 46.

Flexible locator means 50 may take the form of a rubber projection which is snap engaged within the aperture in the cover 46 and protects the ignitor portion 49. In use, the device is placed in the desired position upon the base 51 upon which the floor will be poured whereupon the concrete floor 52 is poured therearound. The upper surface 53 of the concrete floor is situated just slightly above the upper surface of the cover 46 with the locator means 50 extending through the upper surface as clearly illustrated.

This enables the device to be located when it is desired to form the bore through the floor. Under these circumstances, the relatively thin film of concrete 53A is broken away and the locator 50 is pulled from the aperture within the cover 46 is removed and the partially burned and melted core 47 is cleared out thus leaving a smooth cylindrical bore through the concrete which can be used as desired.

The preferred embodiment of the device designed for use in concrete floors, is shown in FIGS. 13 to 16.

This comprises a hollow cylindrical metal or plastic base 54 having an out-turned flange 55 formed on the lower end thereof by the provision of slots 56 thus defining a plurality of outwardly turned tabs 57. This is rested upon the surface 51 upon which the concrete floor 52 is to be poured and this base portion may be secured to the surface 51 either by nails 58 or by staples or other suitable means in order to maintain same in the desired location.

The cylindrical core 47 is similar to that illustrated and described in FIGS. 8 and 9 and this may be pushed downwardly into the base portion 54 until the lower end of this cylindrical core engages the surface 51. The core is held firmly in the base and is prevented from displacement by means of a plurality of inwardly and downwardly facing lug-type projections 59 stamped inwardly from the body of the base portion 54 and these are shown in detail in FIG. 15. These embed within the surface of the core 47 and prevent upward movement thereof once it has been pushed downwardly into position.

An ignitor harness is provided collectively designated 48 taking the form of igniting cords as hereinbefore described. They may either be embedded within the core 47 or, alternatively, may be engaged within vertical grooves 48A formed in the outer vertical wall of the core 47. The upper ends engage within radially extending grooves 60 on the upper surface 61 of the core and terminates substantially centrally with the ignitor portion 49 which is similar to that described in the previous embodiment.

It is desirable to protect the upper end of the core 47 from inadvertent damage and also from mud or water which may occur on the upper surface 53 of the concrete floor 52 after pouring. In this regard, a cylindrical shroud 62 is provided which is open ended and which may be pushed downwardly over the upper end of the core 47 and is held in position by inwardly facing lugs 59A which are similar to lugs 59, but which face inwardly and upwardly as clearly shown in FIG. 15 thus preventing inadvertent displacement of this shroud during the pouring of the concrete floor.

In operation, the base 54 is placed in the desired position and secured as hereinbefore described whereupon the the core 47 is pushed downwardly into engagement with the base and the shroud is then pushed downwardly sufficient so that the upper end 63 of the shroud is situated above the intended upper surface 53 of the concrete.

The ignitor cord harness 48 may be placed in position prior to the core 47 being positioned or, alternatively may be removed if it is not desired to form the bore through the concrete floor immediately.

The concrete floor 52 is then poured in the usual manner and if the bore is desired immediately, the ignitor cord harness may be ignited as soon as the concrete is set thus melting and charring the core so that it can be removed thereby forming the smooth bore through the concrete floor.

If the device has been positioned sometime prior to the pouring of the concrete floor, the core and upper shroud may be removed and stored until it is desired to pour the concrete floor, in order to prevent damage occurring to these parts.

With the base portion 54 already in position, very little time is required to make the final insertion of the core 47 and the shroud 62.

Alternatively, if it is not desired to form the bore immediately, the ignitor cord harness can be removed simply by pulling it from the assembly prior to placing same in position.

Referring back to the embodiment shown in FIGS. 5, 6 and 7, it should also be noted that a flexible plastic cover 15A also is engaged around this sleeve 30 in a manner similar to the cover 15 in order to prevent moisture from entering the device.

The ignitor cord is preferably made from a standard wire which encloses the ignitable material. It is available commercially under the trade mark "THERMOLITE IGNITOR CORD" manufactured by Canadian Industries Limited and one example of the ignitable material is given below although, of course, other materials can be used either together or in combination which produces the desired results

| COMPOUND CHEMICALS: | |
|---|---|
| Polysar Latex (Synthetic) | Sulphur |
| Potassium Oleate Soap | Trimene Base |
| Zinc Oxide Dispersion | Enthazate 50-D |
| Sodium Silico Fluoride | OXAF-W |
| Potassium Nitrate | Carbon |
| Monsanto Lampblack | Water |

The mixing proportions and procedures are given as follows:

| MIXING PROPORTIONS AND PROCEDURES: | |
|---|---|
| Polysar Latex (PL728 Mix) | 26 oz. |
| Potassium Oleate Soap | 80 ml. |
| Water | 20 ml. |

-continued

| MIXING PROPORTIONS AND PROCEDURES: | |
|---|---|
| Carbon | 20 Gr. |
| Sulfur | 140 Gr. |
| Potassium Nitrate | 1300 Gr. |
| Sodium Silico Fluoride | 60 ml. |

The procedure of mixing is as follows. Mix the Potassium Oleate Soap and water with the Polysar Latex Mix. Weigh the carbon and sulphur together and intermix well in a pestle and mortar. This carbon and sulfur is then added to the mixing bowl with the soap, water and latex and the ingredients are beaten to a fairly stiff mix.

The Potassium Nitrate is then added together with the Sodium Silico Fluoride and the remainder of the ingredients and the whole is beaten for a further 30 seconds thus giving a flexible mass which can be used and which then hardens and forms a burnable material not requiring external oxygen.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A bore forming device for concrete floors and the like which are poured upon a supporting surface, comprising in a combination a base portion supportable by the associated supporting surface, a core of semi-rigid material supported by said base portion, ignitor means operatively connected with said core which, when ignited, partially melts and chars said core, and shroud means engaged with the upper end portion of said core, said core including a plurality of vertically situated grooves formed in the wall surface of said core and a plurality of radically extending grooves formed in the upper surface of said core and extending from the upper ends of said vertically situated grooves, said ignitor means comprising an ignitor harness including a plurality of vertically situated cords frictionally engageable within said vertically situated grooves and a plurality of radially extending cords extending inwardly from the upper ends of said vertically situated cords and frictionally engaging within said radially extending grooves, and a common ignitor portion connected to the inner ends of said radially extending cords.

2. The device according to claim 1 in which said base portion is substantially cylindrical, flange means extending outwardly substantially at right angles from the lower end of said base portion being engageable upon the associated supporting surface and being securable thereto, said core and said shroud means also being cylindrical.

3. The device according to claim 1 which includes means to secure said core within said base portion, said last mentioned means including a plurality of lugs extending inwardly and downwardly from the wall of said base portion frictionally engaging the surface of said core.

4. The device according to claim 2 which includes means to secure said core within said base portion, said last mentioned means including a plurality of lugs extending inwardly and downwardly from the wall of said base portion frictionally engaging the surface of said core.

5. The device according to claim 1 which includes means to engage said shroud means with the upper end portion of said core, including a plurality of lugs extending inwardly and upwardly from the wall of said shroud means frictionally engaging the surface of said core.

6. The device according to claim 2 which includes means to engage said shroud means with the upper end portion of said core, including a plurality of lugs extending inwardly and upwardly from the wall of said shroud means frictionally engaging the surface of said core.

7. The device according to claim 3 which includes means to engage said shroud means with the upper end portion of said core, including a plurality of lugs extending inwardly and upwardly from the wall of said shroud means frictionally engaging the surface of said core.

8. The device according to claim 4 which includes means to engage said shroud means with the upper end portion of said core, including a plurality of lugs extending inwardly and upwardly from the wall of said shroud means frictionally engaging the surface of said core.

* * * * *